US006692386B2

(12) United States Patent
Brundage

(10) Patent No.: US 6,692,386 B2
(45) **Date of Patent: *Feb. 17, 2004**

(54) TRAINING SPORTS CLUB AND METHOD

(76) Inventor: Scott Brundage, 5113 Copper River Ave., Las Vegas, NV (US) 89130

( * ) Notice: Subject to any disclaimer, the term of this patent is extended or adjusted under 35 U.S.C. 154(b) by 143 days.

This patent is subject to a terminal disclaimer.

(21) Appl. No.: 09/782,819

(22) Filed: Feb. 13, 2001

(65) Prior Publication Data

US 2002/0082126 A1 Jun. 27, 2002

Related U.S. Application Data

(63) Continuation-in-part of application No. 09/363,995, filed on Jul. 29, 1999, now Pat. No. 6,280,353.

(51) Int. Cl.[7] ..... A63B 59/06
(52) U.S. Cl. ..... 473/457; 473/519; 473/334
(58) Field of Search ..... 473/457, 47, 564–568, 473/519, 520, 334–339

(56) References Cited

U.S. PATENT DOCUMENTS 1,026,990 A * 5/1912 Matson ..... 473/519
1,603,904 A * 10/1926 Cohn ..... 473/519
2,379,006 A * 6/1945 Johnson ..... 473/568
3,116,926 A * 1/1964 Owen et al. ..... 473/457
3,136,546 A * 6/1964 Connolly ..... 473/234
3,392,976 A * 7/1968 Hayes ..... 473/564
3,414,260 A * 12/1968 Gust ..... 482/109
3,578,801 A * 5/1971 Piazza ..... 473/457
3,877,698 A * 4/1975 Volpe ..... 473/520
4,819,941 A * 4/1989 Tanaka ..... 473/234
5,071,123 A * 12/1991 Spector ..... 473/307
5,277,421 A * 1/1994 Rewolinski ..... 473/457
6,280,353 B1 * 8/2001 Brundage ..... 473/457

* cited by examiner

*Primary Examiner*—Mark S. Graham
(74) *Attorney, Agent, or Firm*—Robert Ryan Morishita; Anderson & Morishita, LLC

(57) ABSTRACT

A training sports club comprising a striking portion and a handle portion. The striking portion has a hollow cavity of fixed length formed therein and an opening for accessing the cavity. Removable weights which can be selectively disposed in said cavity in combination are also provided. Disposed inside the cavity is means, such as a support, for removably fixing said weights within the cavity. Optionally, the fixing means may be such that the weights may be positioned at any selected location along the length of said cavity.

19 Claims, 11 Drawing Sheets

TRAINING SPORTS CLUB AND METHOD

RELATED APPLICATION DATA

The present application is a Continuation-in-Part of U.S. Application Serial No. 09/363,995, now U.S. Pat. No. 6,280,353, entitled "Training Baseball Bat and Method" filed Jul. 29, 1999 by Applicant herein.

FIELD OF THE INVENTION

This invention relates generally to sports training apparatus. Specifically, the present invention is a training club, such as a bat, club, racket, or the like, employing multiple internal weights used in combination.

BACKGROUND OF THE INVENTION

The use of various training clubs is well known, and many designs and configurations have heretofore been employed to increase a player's strength and club speed. The increased club speed achieves the desired result of increasing the distance a ball will travel when struck. This result is advantageous in many sports including baseball, softball, golf, and the like.

For example, many methods and devices have been invented to assist a player in increasing baseball bat speed. Among these are "doughnut" weights, which derive their name from their doughnut shape. Doughnut weights slide over the knob end of a bat and fit snugly around the barrel portion of the bat. The ball player then swings the weighted bat to increase strength during practice and to warm up during a game. However, one drawback of the doughnut weight is that the resultant swing motion can be unnatural because the position of the weight may not be adjusted along the length of the barrel portion of the bat. That is, rather than resting at a selected position along the barrel of the bat, the doughnut weight rests where the interior hole of the weight bears against the tapered barrel. Moreover, the external location of the weight near or on the barrel prevents the ball player from hitting balls with the weighted bat. Furthermore, doughnut weights have a tendency to become jammed on the bat and can be difficult to remove. In fact, in many instances a jammed weight can damage the bat.

Similarly, other designs employ weights either disposed on the outside of the barrel portion of a baseball bat (Wales, U.S. Pat. No. 5,050,877) or extending axially from the knob portion of the bat (Nolan, U.S. Pat. Nos. 5,674,138 and 5,741,193). Again, the inability to adjust the location of the weights in these designs produces an unnatural swing motion.

Yet another design incorporates internal weights into the barrel of the sports club. For example, the design disclosed in Rewolinski, U.S. Pat. No. 5,277,421, includes a single weight disposed on a stem in the barrel portion of the bat. The stem and weight are received in an axial sleeve in the end portion of the bat. Therefore, a ball player cannot use weights in combination to enhance training, and thus, one disadvantage of the Rewolinski design is that it cannot accommodate more than one weight at a time. Rather, a player must remove the weight currently disposed in the bat before inserting a different weight, which limits the selection of total weight that can be disposed in the bat at any given time.

Therefore, it can be appreciated that there exists a continuing need for a new and improved training bat with a weighting system which permits disposing multiple weights in the bat simultaneously as training requires. These and other advantages will be provided by the training bat set forth in this patent application.

SUMMARY OF THE INVENTION

The present invention is a training sports club. The club of the present invention includes a handle and a striking portion. The club take many forms including that of a baseball bat, softball bat, golf club, racket, or the like. Thus, for example, if the club takes the form of a baseball bat, the striking portion is the barrel of the bat; if the club takes the form of a golf club, the striking portion is the club head; and so forth.

The striking portion includes a hollow cavity of fixed length formed therein. The cavity is accessible through an opening. A removable cap for closing the opening may be provided in an optional embodiment. The cap may be lockable, such as through locking pins disposed on the cap engaging slots proximate the cavity.

A plurality of removable nestable weights are provided. The weights may be selectively disposed in the cavity in combination. In one optional embodiment, the weights are shaped with a chamber therein such that each successive weight may nest inside the preceding weight. In an alternate embodiment, the weights are stackable such that the weights may be selectively combined to comprise a desired weight.

Means for removably fixing the weights at any selected location along the length of the cavity are also provided. For example, the positioning means could include a rod disposed in the cavity about which the weights may be positioned in nesting fashion, a plurality of fixed or removable supports supporting at least a portion of the perimeter of the weights, or the like. Optionally, the training club further includes means, such as a velocimeter, accelerometer, or the like, for measuring the speed of the club when swung.

In one example of the present invention, the sports club could be in the form of a baseball bat. In such an embodiment, the barrel portion of the bat has a hollow cavity and an opening for accessing the cavity. A support is disposed in the cavity. A first weight shaped to removably nest within the cavity may be removably engaged to the support such as a rod. In this fashion, the first weight may be secured at a selected location along the length of the cavity. The first weight includes a chamber therein to receive at least a second weight. In an optional embodiment, a cap is provided for closing the opening so that the weights may be fixedly secured inside the barrel cavity. In an embodiment including a cap, the support may be secured to the cap so that it may be removed from the cavity.

Optionally, the opening for accessing the cavity is located at the end of the barrel portion of the bat. The weights may optionally be cylindrical or frustoconical in shape. In an optional embodiment, the means for closing the opening comprises a cap which can be attached to the barrel portion with threads, bayonet connectors, locking pins, or other similar structure.

In accordance with one aspect of the invention, the training bat further comprises a means such as a velocimeter, accelerometer, or the like, for measuring the speed of the bat when swung. Optionally, the measuring means would include a means for displaying the speed of the bat measured by the measuring means. In one embodiment, the display means would continue to display the highest speed measured until the ball player reset the display means.

In an embodiment in which the sports club takes the form of a golf club, the club head includes a hollow cavity of fixed length formed therein and an opening for accessing the cavity. Optionally, a cap is provided to close the opening. Optionally, the cap may be locking such as through locking pins or the like.

A support is disposed within the cavity. The support may take many forms including support shelves engaging the perimeter of the weights. A first weight shaped to removably nest within the cavity is engaged to the support such that the first weight is securely positioned at a selected location along the length of the cavity. A second weight is also provided that may also be engaged to the support in combination with the first weight. As above, means, such as an accelerometer, velocimeter, or the like, may be provided to measure the speed of the club when swung.

Therefore, it is an object of the present invention to provide a sports club that may receive weights in combination for sports training purposes.

Still other objects and advantages of the present invention will become readily apparent to those skilled in this art from the following detailed description. As will be realized, the invention is capable of other and different embodiments, and its several details are capable of modifications in various obvious respects, all without departing from the invention. Accordingly, the drawings and description are to be regarded as illustrative in nature, and not as restrictive.

DESCRIPTION

Figure 1:
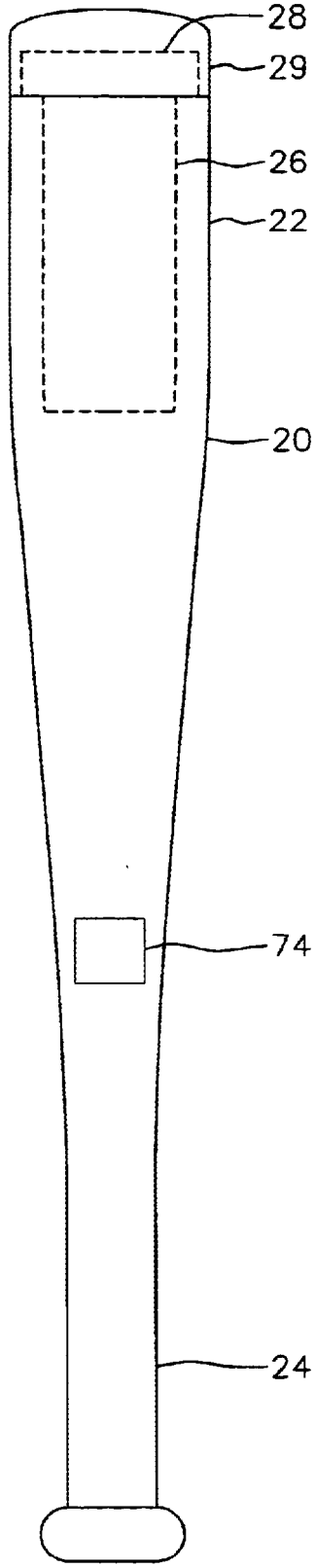
FIG. 1 is a plan view of a training bat according to an embodiment of the present invention.
Figure 1A:
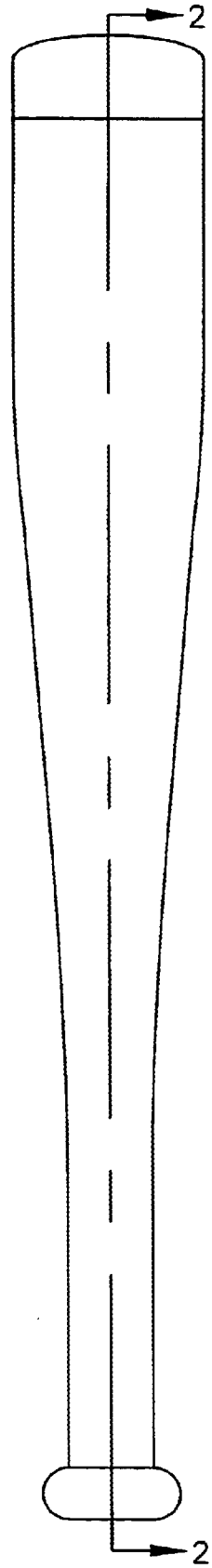
FIG. 1A is a side view of a training bat of the embodiment of FIG. 1.

Reference is now made to the figures wherein like parts are referred to by like numerals throughout. With reference to FIGS. 1 and 14, a training sports club 20, 120 is provided to assist a user in increasing the user's swing speed. The training sports club 20, 120 may take many forms including that of a baseball bat 20, softball bat 20, golf club 120, sports racket (not shown), or any other sports club that is swung during the course of participation in the sport. Thus, the following description of specific embodiments for a baseball bat 20 (FIGS. 1–13) and a golf club 120 (FIGS. 14–18) should be considered exemplary and not limiting in nature.

Referring generally to the figures, the present invention is a training sports club 20, 120 including a handle portion 24, 124 and a striking portion 22, 122. When referring to the striking portion 22, 122 of the present invention, it is noted that the striking portion 22, 122, e.g. barrel 22, head 122, or the like, need not be capable of actually striking a ball but may, in an optional embodiment, merely be shaped like the striking portion 22, 122 of an actual non-training club to properly simulate use of an actual club for training purposes. The striking portion 22, 122 includes a hollow cavity 26, 126 of fixed length therein. While the cavity 26, 126 could take any form, in an optional embodiment, the cavity 26, 126 is substantially congruent to the cross section of the striking portion 22, 122 of the club 20, 120 so that uneven weight distribution does not interfere with the user's swing of the club 20, 120. Thus, it can be seen that the cavity 26 in a baseball embodiment (FIGS. 1–13) is substantially cylindrical or frustoconical and the cavity 126 in a golf embodiment (FIGS. 14–18) is substantially oblong.

The club 20, 120 includes an opening 28, 128 to allow access to the cavity 26, 126. Optionally, a removable cap 29, 129 may be provided to close the opening 28, 128. The cap 29, 129 may be locked in place using locking pins 31, 131 engaging slots 33, 133 in an optional embodiment.

A plurality of removable weights 30, 130 are provided. The weights 30, 130 are shaped to nestably fit inside the cavity 26, 126 in combination. To insure that the weights 30, 130 do not move about in the cavity 30, 130, particularly when fewer than all the weights 30, 130 are disposed in the cavity 26, 126, means are provided for removably fixing the weights 30, 130 at a selected location along the length of said cavity 26, 126. In a further optional embodiment, the fixing means may be such that the weights may be removably fixed at any selected location along the length of said cavity 26, 126 to properly position the weights 30, 130 in the cavity 26, 126 so that they do not interfere with the user's swing or cause an awkward swing. In other words, in such an embodiment, the fixing means is used to fix the weights 30, 130 as well as to position the weights 30, 130 at any selected position along the length of the cavity 26, 126. As shown in the figures, the fixing means could be a support, rod 25, shelf 125, or the like that can be removably engaged to the weights 30, 130 to allow interchanging of weights 30, 130 yet secure the weights 30, 130 from moving during use.

Figure 2:
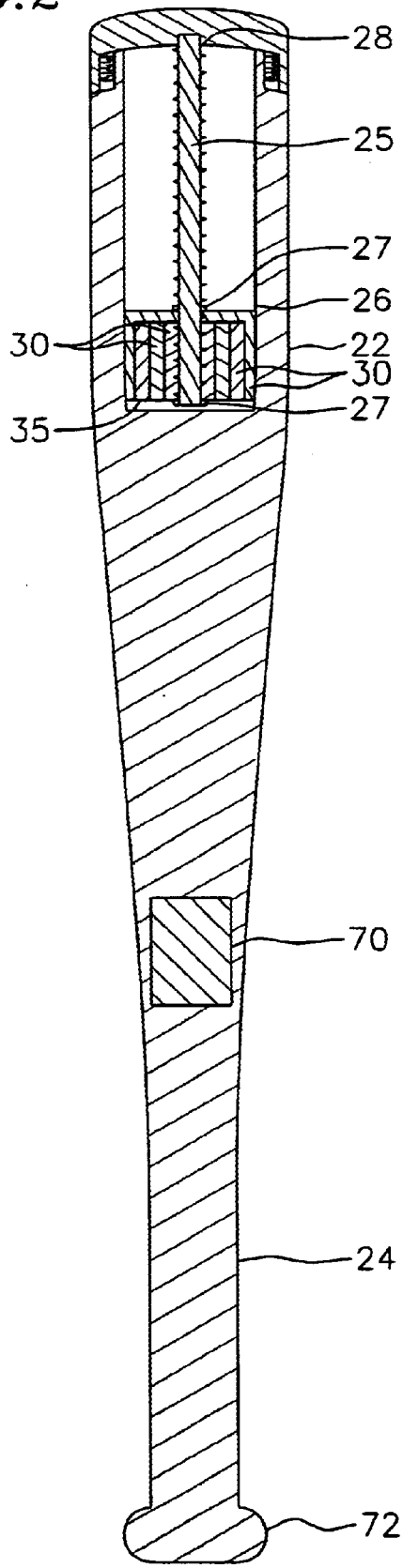
FIG. 2 is a cross-sectional view of a training bat taken across line II—II in FIG. 1A.

Looking at example embodiments of the present invention, in FIGS. 1–13, a training baseball bat 20 comprises a barrel portion 22 and a handle portion 24. A hollow cavity 26 is formed within the barrel portion 22. The cavity 26 is accessible via an opening 28. As shown in FIG. 2, a plurality of nestable weights 30 can be disposed in combination inside the barrel cavity 26 via the opening 28. These weights 30 may be substantially cylindrical as shown in FIG. 2, or, in an alternate embodiment, the weights 30' may be substantially frustoconical as shown in FIG. 3.

Figure 3:
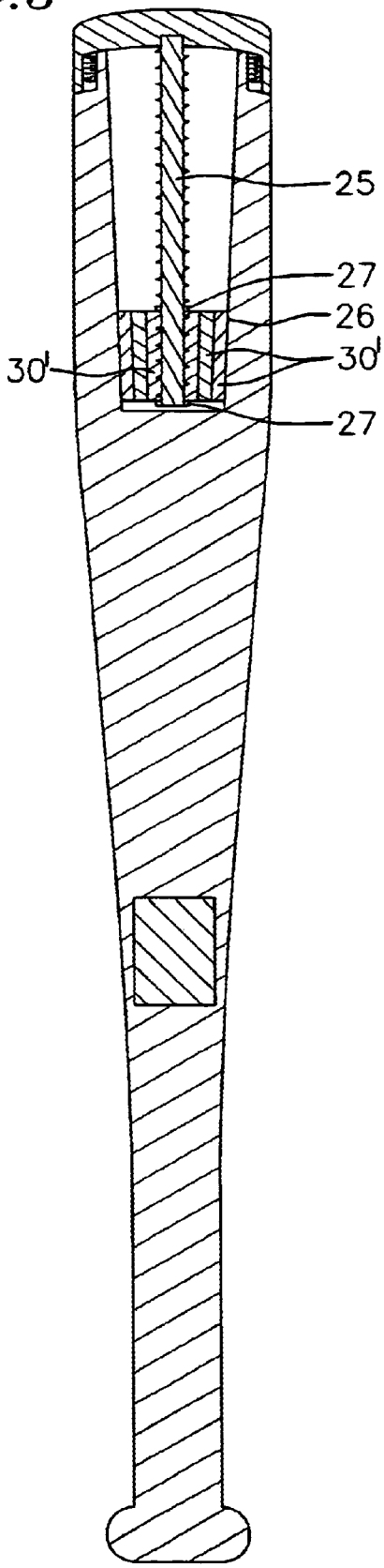
FIG. 3 is an alternate embodiment of a cross-sectional view of a training bat taken across line II—II in FIG. 1A.
Figure 4:
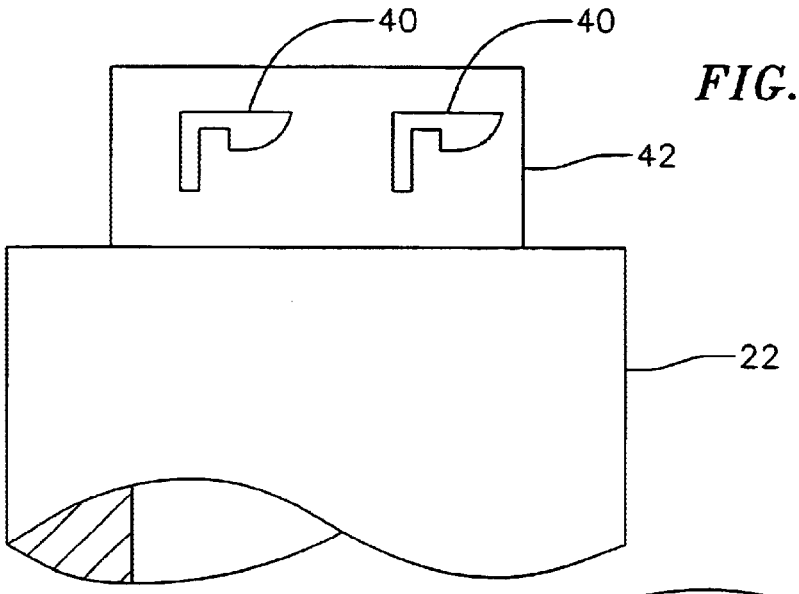
FIG. 4 is a partial view of an embodiment of a barrel of a training bat.
Figure 5:
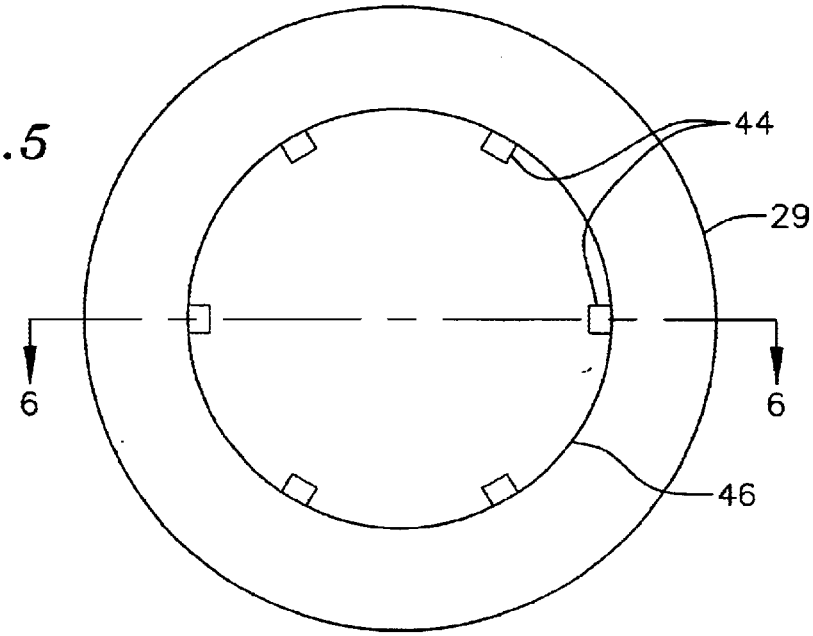
FIG. 5 is a bottom view of the cap of FIG. 4.
Figure 6:
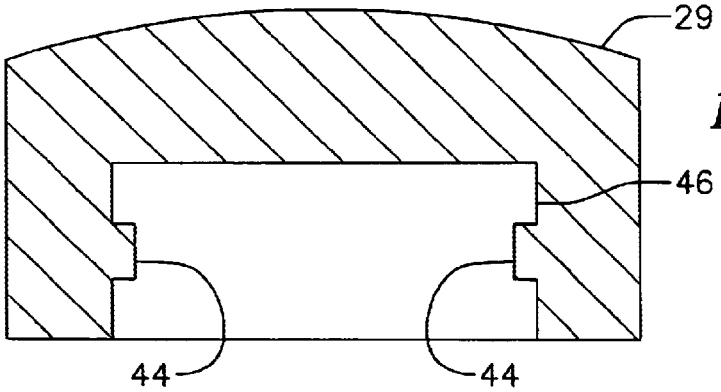
FIG. 6 is a cross-sectional view of the cap of FIG. 5 taken across line VI—VI in FIG. 5.

Referring to FIGS. 1–3, fixing means is provided to removably fix the nestable weights 30 within the cavity 26. Optionally, the fixing means is a support in the form of a rod 25 upon which the cylindrical weights 30 may be disposed. In a further optional embodiment, the fixing means may be such that the weights 30 may be adjustably located at any selected position along the length of the cavity 26. In such an optional embodiment, the rod 25 is threaded such that threaded fasteners 27 may be used to secure the weights 30 at any selected position on the rod 25. In an embodiment including a cap 29, described below, the rod 25 may be attached to the cap 29 so that the rod 25 may be removed from the cavity 26 to facilitate engagement of the weights 30 to the rod 25.

Returning to FIG. 1, in an optional embodiment, a cap 29 is secured to the barrel portion 22 of the bat 20 to secure the weights 30 inside the cavity 26. In the embodiment illustrated in FIGS. 4–6, bayonet connectors 40 are disposed on the outer diameter of a cylindrical protrusion 42 that extends outwardly from the barrel 22. Tabs 44 disposed on the inner diameter of an annular recess 46 formed within the cap 29 are positioned such that they may fixedly engage complementary bayonet connectors 40 on the cylindrical protrusion 42.

Figure 8:
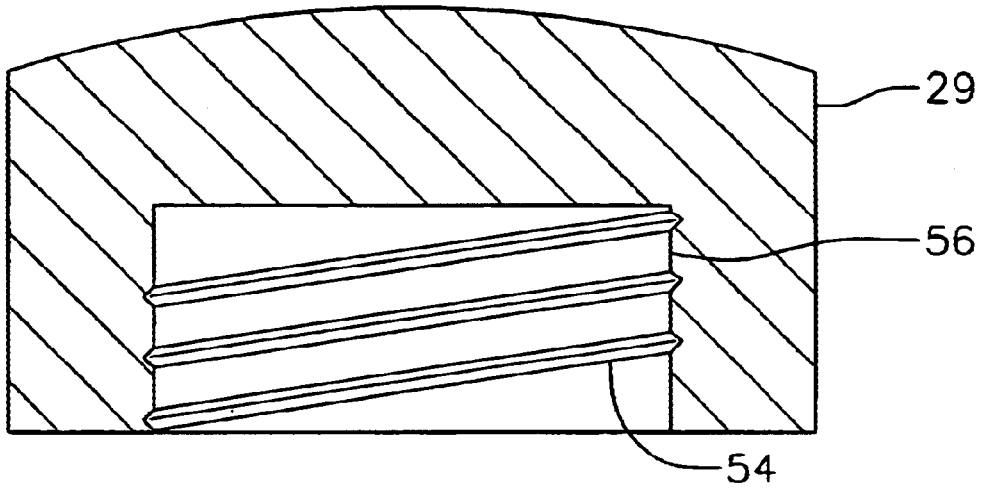
FIG. 8 is a cross-sectional view of a cap of engagable to the barrel of FIG. 7.
Figure 7:
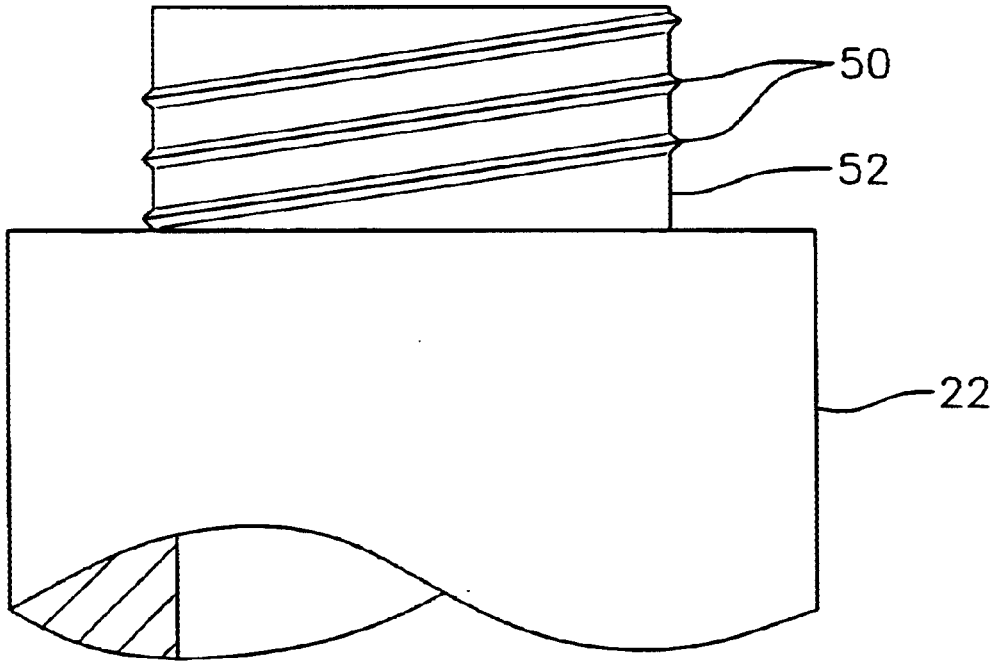
FIG. 7 is a partial view of an alternate embodiment of a barrel of a training bat.

FIGS. 7–8 illustrate another embodiment in which the cap 29 is secured to the barrel portion 22 in an alternative fashion. Namely, threads 50 are disposed on the outer surface of a cylindrical protrusion 52 that extends outwardly from the barrel 22. Threads 54 disposed on the inner surface of an annular recess 56 formed within the cap 29 are designed to mate with the threads 50 disposed on the cylindrical protrusion 52 that extends outwardly from the barrel 22.

Figure 10:
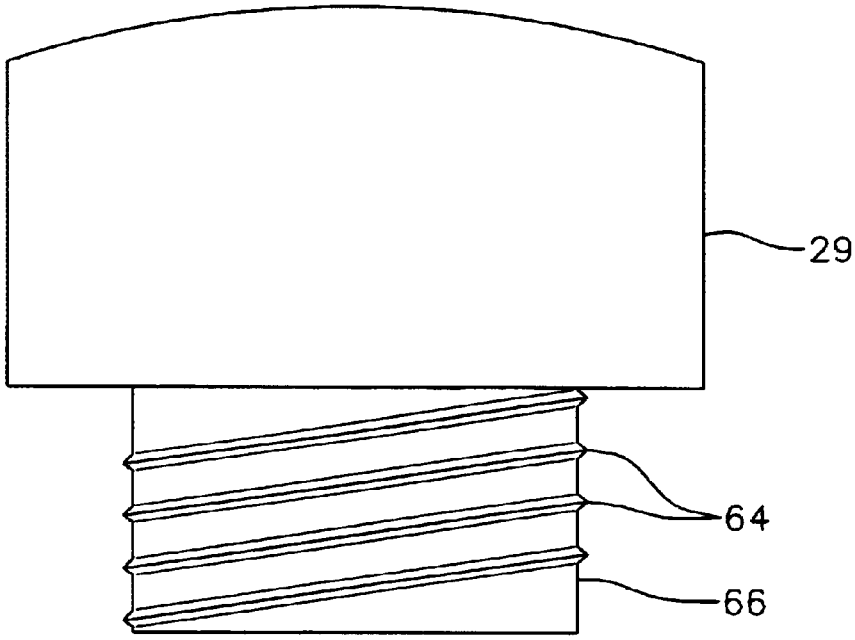
FIG. 10 is a partial view of a cap engagable to the barrel of FIG. 9.
Figure 9:
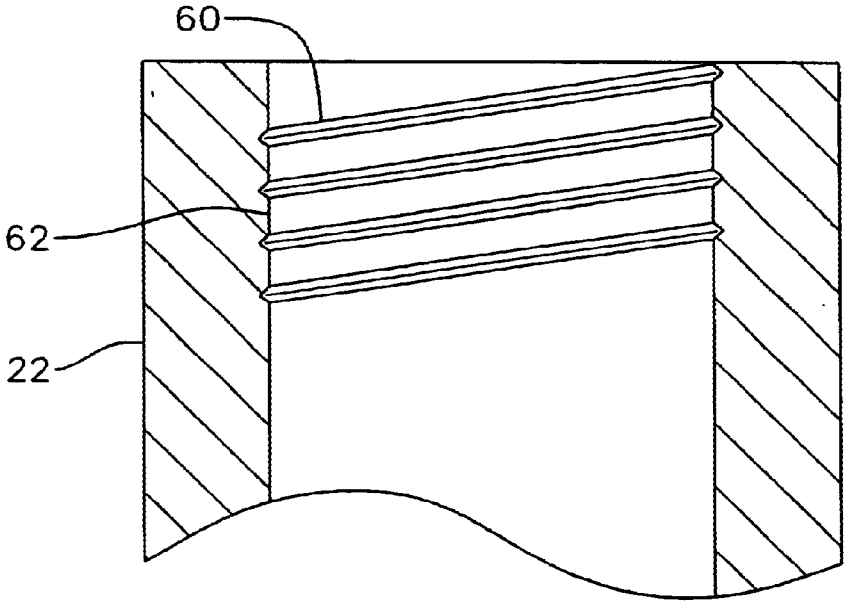
FIG. 9 is a cross-sectional view of an alternate embodiment of a barrel of a training bat;.

Yet another embodiment is depicted in FIGS. 9 and 10 in which the cap 29 is secured to the barrel portion 22. In particular, threads 60 are disposed on the inner surface of an annular recess 62 formed within the barrel portion 22. Threads 64 disposed on the outer surface of a cylindrical protrusion 66 that extends outwardly from the cap 29 are designed to mate with the threads 60 disposed on the annular recess 62 formed within the barrel portion 22.

Figure 12:
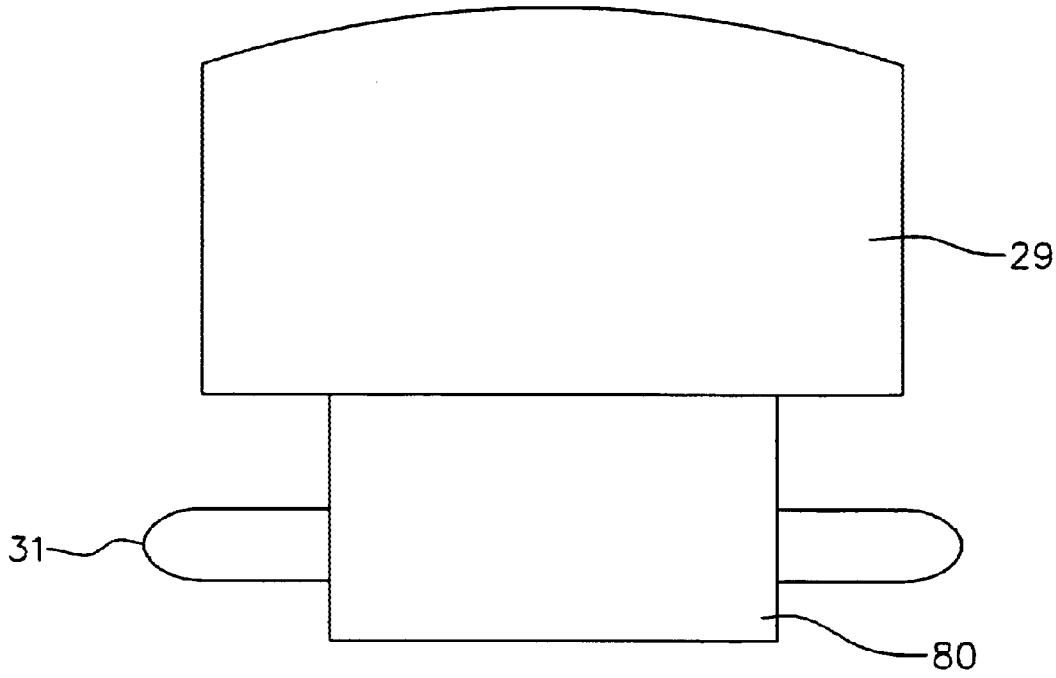
FIG. 12 is a partial view of a cap engagable to the barrel of FIG. 11.
Figure 11:
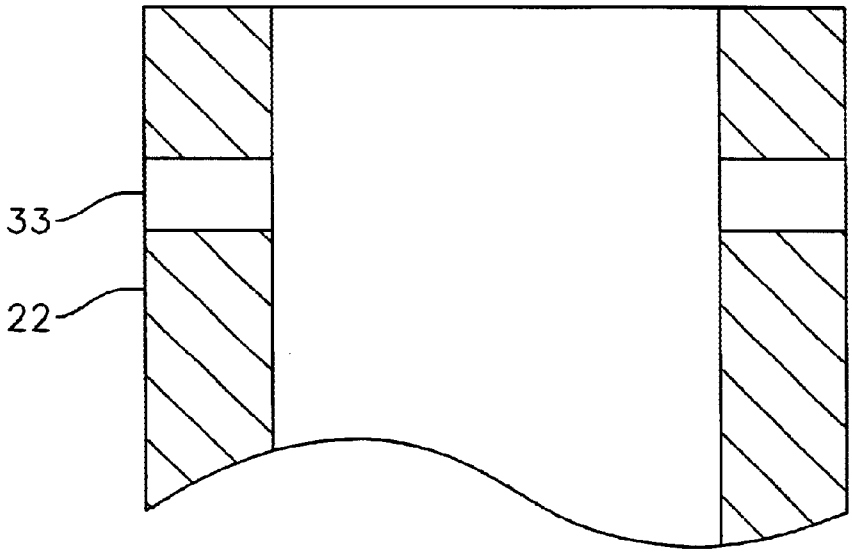
FIG. 11 is a cross-sectional view of an alternate embodiment of a barrel of a training bat;.

In yet another embodiment shown in FIGS. 11 and 12, the cap 29 may include a flange 80 that is inserted into the end of the cavity and includes locking pins 31. Optionally the locking pins 31 are biased, such as with a spring, in a protruding fashion. The locking pins 31 engage slots 33 in the barrel 22 proximate the opening 28 in a sliding fit. Thus, when the flange 80 is inserted into the cavity 26 and the locking pins 31 are aligned with the slots 33, the locking pins 31 are biased outwardly to engage the slots 33 and thereby securely close the opening 28.

Returning to FIGS. 1–2, means for measuring bat speed 70, such as a velocimeter, accelerometer, radar, or the like, is located between the knob 72 at the end of the handle portion 24 and the barrel portion 22. The measured speed is then indicated by a display means 74 on the exterior of the bat 20. In one embodiment, the display means 74 continuously displays the highest speed measured by the measuring means 70 until the ball player resets the display means 74.

Figure 13:
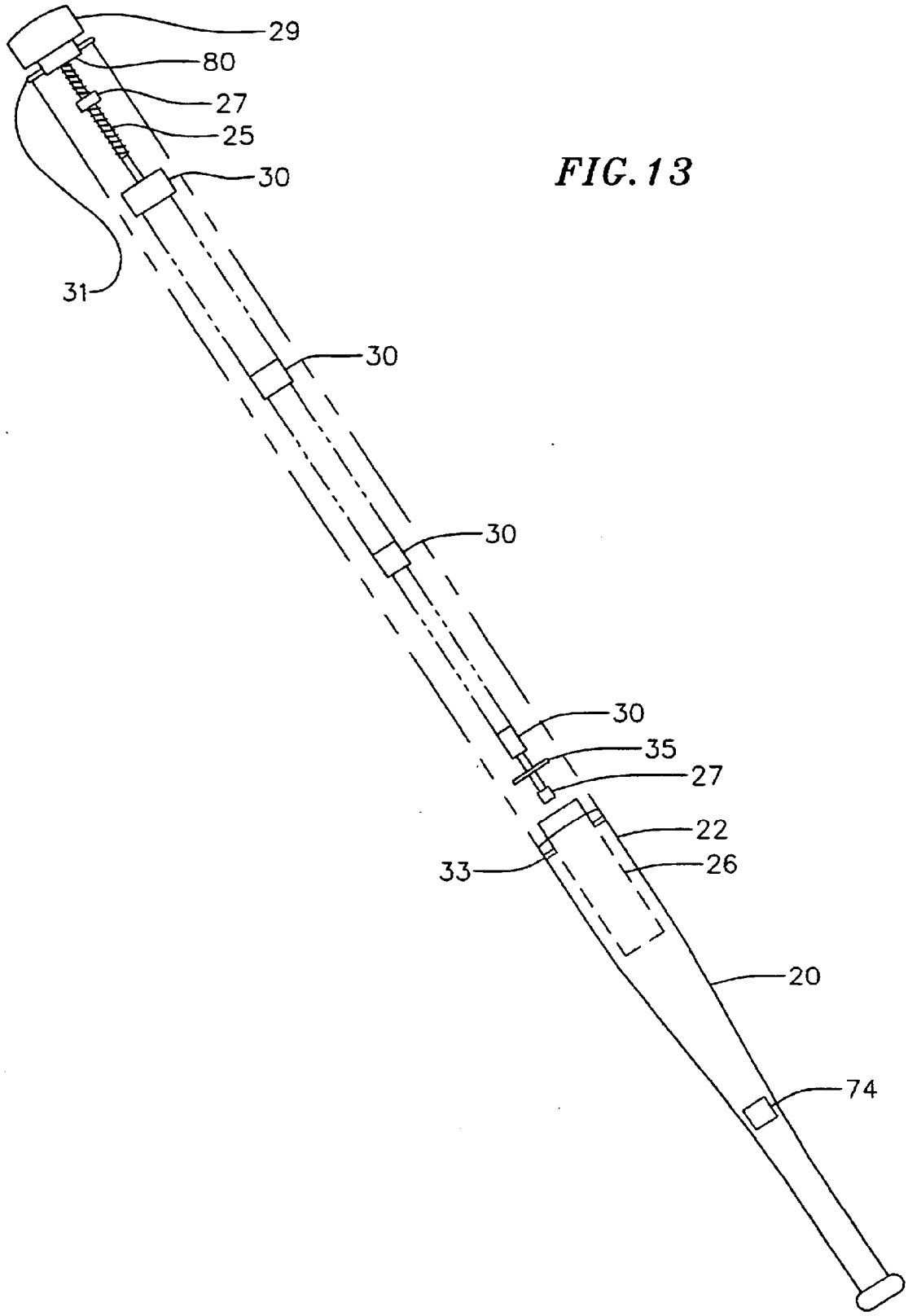
FIG. 13 is an assembly view of a training bat according to an embodiment of the present invention.
Figure 14:
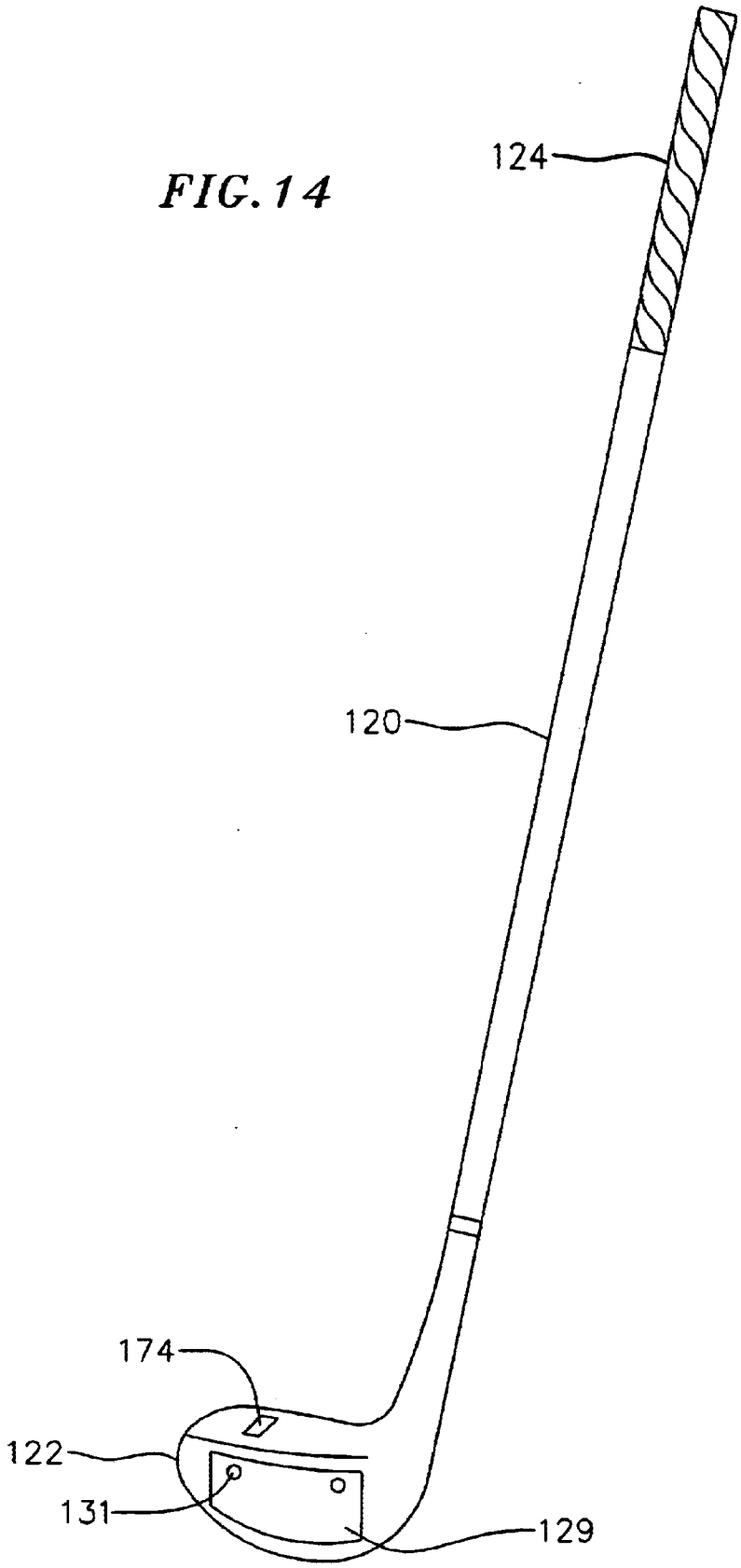
FIG. 14 is an elevated perspective view of a golf club according to an embodiment of the present invention.

FIG. 13 illustrates how the weights 30 nest inside the bat 20. While any number of nestable weights 30 could be used, in an optional embodiment, four weights 30*a–d* are provided. Optionally, the first weight 30*a* is substantially the same length as the cavity 26 to prevent the first weight 30*a* from moving within the cavity 26 when the bat 20 is swung. Furthermore, the second weight 30*b* is substantially the same length as the hollow portion of the first weight 30*a*. Similarly, the third weight 30*c* is approximately the same length as the hollow portion of the second weight 30*b*. Finally, the fourth weight 30*d* is substantially the same length as the hollow portion of the third weight 30*c*.

The first weight 30*a* is hollow and shaped to nest within the cavity 26. The second weight 30*b* is also hollow and nests within the first weight 30*a*. The third weight 30*c* is hollow and nests within the second weight 30*b*. The final weight, which is the fourth weight 30*d* in this embodiment, is solid and nests within the previous weight, which is the third weight 30*c* in this embodiment. The cap 29 can be secured to close the opening 28 and thereby fixedly secure the weights 30 inside the cavity 26 or removed to allow access to the cavity 26 as required by the ball player.

Still referring to FIG. 13, a ball player wishing to increase their bat speed with the training bat 20 would initially engage the first weight 30*a* to the support inside the cavity 26 via the opening 28. In the embodiment using a rod 25, this step involves placing the first weight 30*a* on the rod 25 and inserting the rod 25 into the cavity 26. Optionally, the position of the weight 30*a* on the rod 25 may be secured and adjusted using the threaded fasteners 27 bearing against a plate 35. The ball player would then secure the cap 29 to the barrel portion 22, effectively securing the first weight 30*a* inside the cavity 26. Subsequently, the ball player would swing the training bat 20 a predetermined number of times (a "set"), remove the cap 29, and nest the second weight 30*b* inside the first weight 30*a*. Again, the ball player would secure the cap 29 to the barrel 22 and swing the bat 20 a predetermined number of times. Similarly, the ball player would remove the cap 29, nest the third weight 30*c* inside the second weight 30*b*, secure the cap 29 to the barrel 22, and swing the bat 20 a predetermined number of times. Finally, the ball player would remove the cap 29, nest the fourth weight 30*d* inside the third weight 30*c*, secure the cap 29 to the barrel 22, and swing the bat 20 a predetermined number of times. If the ball player desires, the process may further include reversing the steps; that is, removing the weights 30 in a serial fashion in between sets. The display means 74 is used throughout the training regimen to objectively determine whether the ball player's bat speed is increasing.

The design set forth in this application lends itself to a flexible training program whereby a ball player may use weights 30 in combination. Specifically, while the weights 30 could be of any weight, in an optional embodiment for children, four seven-ounce weights are used in conjunction with a nine ounce bat. Thus, the young ball player would have the option of training at five different levels ranging from nine ounces to thirty-seven ounces. Similarly, another embodiment for adults utilizes four ten-ounce weights together with a nine ounce bat. Thus, the ball player would have the option of training at five different levels ranging from nine ounces to forty-nine ounces.

Figure 15:
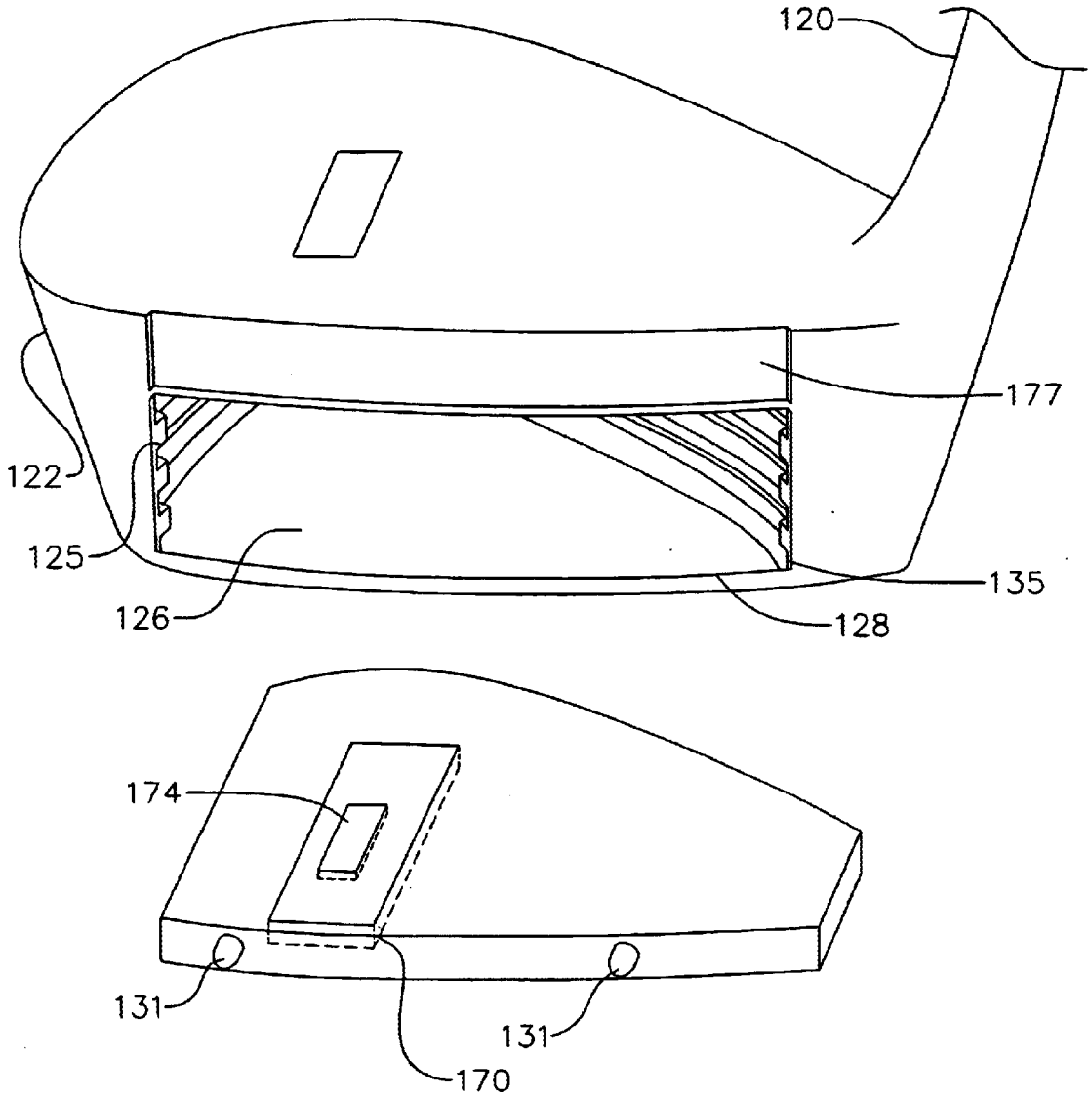
FIG. 15 is an elevated perspective view of the head of a club according to an embodiment of the present invention.
Figure 16:
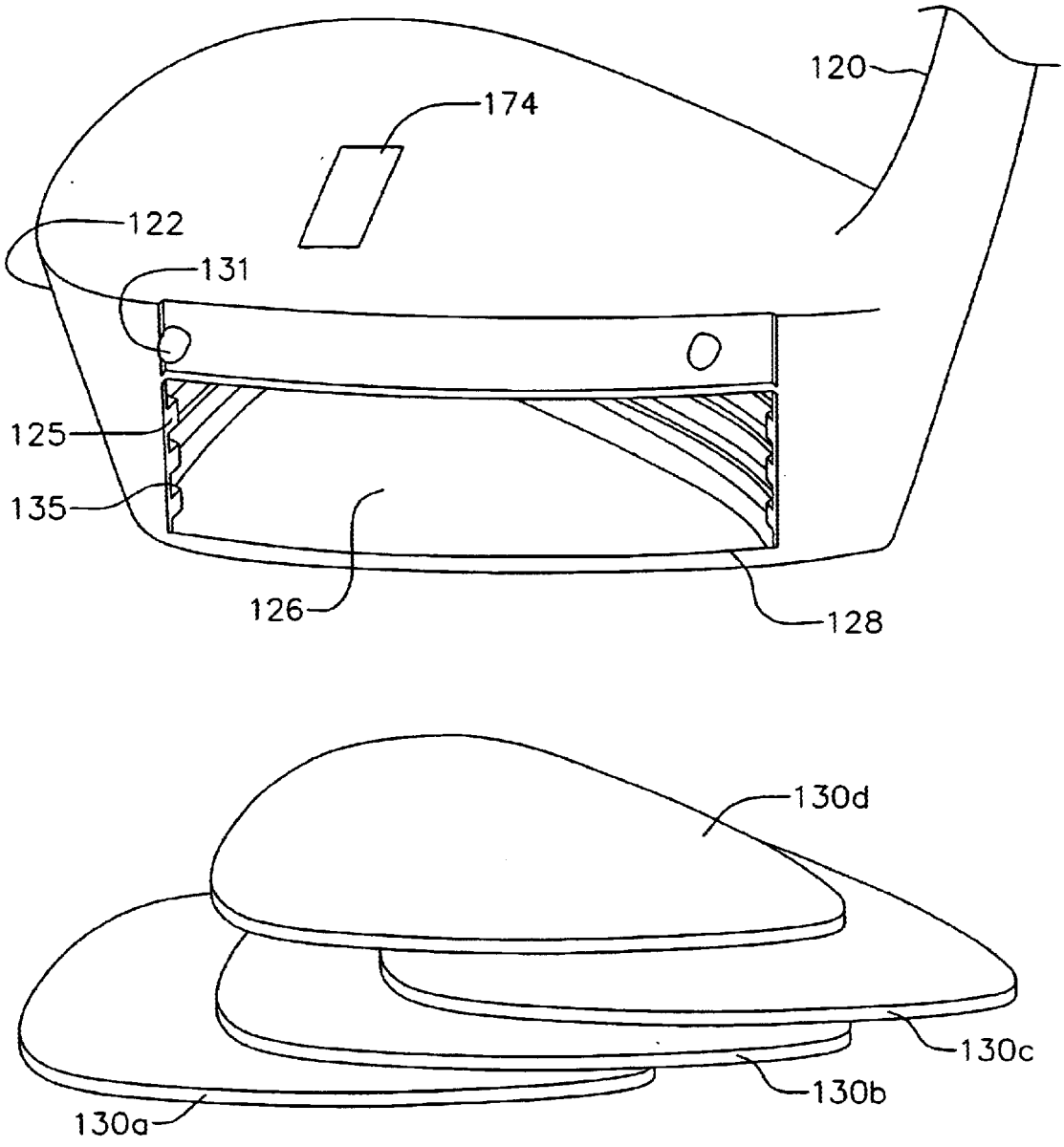
FIG. 16 is an elevated perspective view of the head of FIG. 12 with the measuring means and display mounted in the head.

Referring to FIGS. 14–18, the sports club 20, 120 of the present invention may also take the form of a golf club 120. As shown in FIG. 14, in such an embodiment, a training golf club 120 comprises a head 122 and a handle 124. With reference to FIGS. 15 and 16, a hollow cavity 126 is formed within the head 122. The cavity 126 is accessible via an opening 128. As shown if FIG. 17, a plurality of removable weights 130 can be disposed in combination inside the cavity 126 via the opening 128. These weights 130 may be substantially flat with a shape substantially congruent to the cross section of the head 122.

Means, such as a support, for removably fixing the weights 130 at a selected location inside the cavity 126 are provided. The fixing means secures the weights 130 at a selected location when the weights 130 are disposed in the cavity 126. In the optional embodiment shown in FIGS. 14–18, the fixing means is a support in the form of removable or fixed shelf or shelves 125 that engage the weights 130 or, alternatively, the perimeter of the weights 130.

Figure 17:
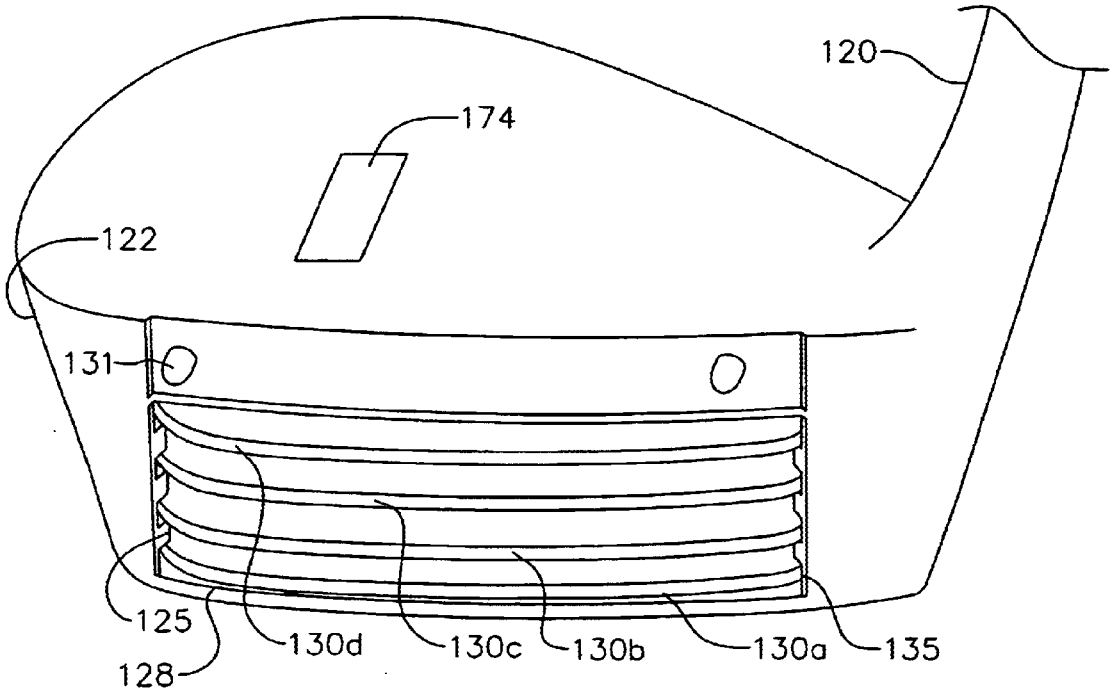
FIG. 17 is an elevated perspective view of the head of the present invention with the weights, measuring means, and display mounted in the head.
Figure 18:
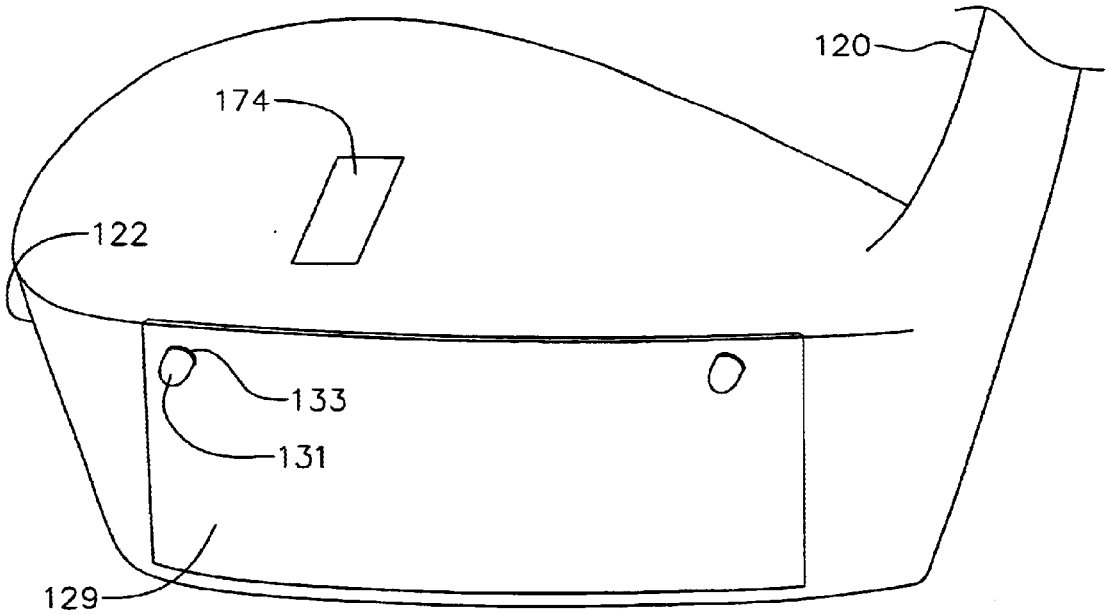
FIG. 18 is an elevated perspective view of the head of the present invention with the cap secured to the head.

Referring to FIG. 18, in an optional embodiment, a cap 129 is secured to the head 122 of the golf club 120 to secure the weights 130 inside the cavity 126. In the embodiment shown in FIGS. 15–17, the head 122 may include locking pins 131 proximate the opening 128 and extending therefrom and a recess 135 for receiving the cap 129 having slots 133 thereon. Optionally, the locking pins 131 are biased, such as with a spring, to protrude away from the opening 128. When the cap 129 is inserted into the recess 135 and the locking pins 131 are aligned with the slots 133, the locking pins 131 are urged outwardly to engage the slots 133 and thereby securely close the opening 128.

Returning to FIGS. 14–18, means for measuring club speed 170, such as a velocimeter, accelerometer, radar, or the like, is provided. In an optional embodiment, the measuring means 170 is located in the club head 122. The measured speed is indicated by a display 174 on the exterior of the club 120. In one embodiment, the display 174 continuously displays the highest speed measured by the measuring means 170 until the user resets the display 174. Optionally, the measuring means 170 may be removable from the head 122 of the club 120 as shown in FIG. 15. In such an embodiment, the measuring means may fit inside a compartment 177 at the top of the head 122. In an optional embodiment, the locking pins 131 may be mounted to the removable measuring means 170.

FIG. 17 illustrates how the weights 130 fit inside the golf club 120. While any number of weights 130 could be used, in an optional embodiment, four weights 130*a–d* are provided. Optionally, the first weight 130*a* is substantially congruent to the shape of the cavity 126 to prevent the first weight 130*a* from moving within the cavity 126 when the golf club 20 is swung. Similarly, the second weight 130*b*, third weight 130*c*, and fourth weight 130*d* are fit snugly inside the supports within the cavity 126 to prevent movement.

The weights are disposed inside the cavity in combination. That is, any combination of the first weight 130*a*, second weight 130*b*, third weight 130*c*, and fourth weight 130*d* may be disposed inside the cavity 126 during use by engaging the desired weight 130 or weights 130 to the support. Once the desired weight combination is disposed inside the cavity 126 and engaged to the support, the cap 129 can be secured to close the opening 128 and thereby fixedly secure the weights 130 inside the cavity 126. To change the weight combination, the cap 129 may be removed to allow access to the cavity 126 as required by the user.

With reference to FIGS. 17 and 18, a user wishing to increase their club speed with the training club 120 would initially insert the first weight 130*a* into the cavity 126 via the opening 128. The user secures the cap 129 to the head 122, effectively securing the first weight 130*a* inside the cavity 126. Subsequently, the user would swing the training club 120 a predetermined number of times (a "set"), remove the cap 129, and engage the second weight 130*b* to the support inside the cavity 126. Again, the user would secure the cap 129 to the head 122 and swing the club 120 a predetermined number of times. This process would be repeated as desired. As above, the process may further include reversing the steps; that is, removing the weights 130 in a serial fashion in between sets. The display means 174 is used throughout the training method to objectively determine whether the user's club speed is increasing.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be considered to fall within the scope of the invention.

I claim:

1. A training sports club comprising:

a striking portion and a handle portion, the striking portion having a hollow cavity of fixed length formed therein and an opening for accessing said cavity;

a plurality of removable weights which can be selectively disposed in said cavity in combination, one of said weights having a chamber therein, and another of said weights shaped to be received into said chamber to removably nest therein; and a support disposed in said cavity, said weights removably fixed to said support in combination at any selected location along the length of said cavity.

2. The training club of claim 1 wherein said support is a rod received in said cavity.

3. The training club of claim 1 further comprising means for measuring the speed of the club when swung.

4. The training club of claim 1 further comprising a removable cap for lockably closing said opening, the cap cooperating with the hollow cavity to contain and secure said removable weights.

5. The training club of claim 4 further comprising:

slots disposed in said striking portion adjacent said opening; and locking pins secured to said cap, said pins positioned on said cap to engage said slots when said cap closes said opening.

6. A training baseball bat comprising:

a baseball bat having an integral handle and barrel, said barrel having a hollow cavity formed therein and an opening for accessing said barrel cavity;

a support disposed within said barrel cavity;

a first weight with a chamber therein, said first weight shaped to removably nest within said barrel cavity, said first weight engaging said support; and a second weight shaped to be received into the chamber of the first weight to removably nest therein.

7. The baseball bat of claim 6 further comprising a removable cap for lockably closing said opening.

8. The baseball bat of claim 7 further comprising:

slots disposed in said barrel adjacent said opening; and locking pins secured to said cap, said pins positioned on said cap to engage said slots when said cap closes said opening.

9. The baseball bat of claim 6 wherein said support is a removable rod.

10. The baseball bat of claim 7 wherein said support is secured to said cap such that said support is removed from said cavity when said cap is removed from said opening and disposed inside said cavity when said cap closes said opening.

11. The baseball bat of claim 8 further comprising means for measuring the speed of the bat when swung.

12. The baseball bat of claim 6 wherein said barrel cavity is of fixed length and said first weight may be removably fixed to said support at any selected location along the length of said cavity.

13. A training baseball bat comprising:

a baseball bat having an integral handle and barrel, said barrel having a hollow cavity of fixed length formed therein and an opening for accessing said barrel cavity;

a support disposed within said barrel cavity;

a first weight with a hollow chamber therein, said first weight shaped to removably nest annularly inside said barrel cavity, said first weight engaging said support; and a second weight with substantially the same shape as the chamber of the first weight and of smaller graduated size to be received into the chamber of the first weight to removably nest annularly therein.

14. The baseball bat of claim 13 further comprising a removable cap for lockably closing said opening.

15. The baseball bat of claim 14 further comprising:

slots disposed in said barrel adjacent said opening; and locking pins secured to said cap, said pins positioned on said cap to engage said slots when said cap closes said opening.

16. The baseball bat of claim 13 wherein said support is a removable rod.

17. The baseball bat of claim 14 wherein said support is secured to said cap such that said support is removed from said cavity when said cap is removed from said opening and disposed inside said cavity when said cap closes said opening.

18. The baseball bat of claim 13 further comprising means for measuring the speed of the bat when swung.

19. The baseball bat of claim 13 wherein said barrel cavity is of fixed length and said first weight may be removably fixed to said support at any selected location along the length of said cavity.

* * * * *